US006854288B2

(12) United States Patent
Uijen

(10) Patent No.: US 6,854,288 B2
(45) Date of Patent: Feb. 15, 2005

(54) REFRIGERATION APPARATUS

(75) Inventor: Wilhelmus Adrianus Theodorus Uijen, Col Santa Ma Insurgentes (MX)

(73) Assignee: Good Humor—Breyers Ice Cream, division of Conopco, Inc., Green Bay, WI (US)

( * ) Notice: Subject to any disclaimer, the term of this patent is extended or adjusted under 35 U.S.C. 154(b) by 0 days.

(21) Appl. No.: 10/688,580

(22) Filed: Oct. 17, 2003

(65) Prior Publication Data

US 2004/0112081 A1 Jun. 17, 2004

(30) Foreign Application Priority Data

Oct. 17, 2002 (EP) ..... 02257199

(51) Int. Cl.[7] ..... F25D 11/02; F25D 19/00
(52) U.S. Cl. ..... 62/441; 62/452
(58) Field of Search ..... 62/441, 440, 452, 62/498, 237, 457.9; 221/150 R, 150 HC

(56) References Cited

U.S. PATENT DOCUMENTS 3,729,243 A 4/1973 Musgrave et al.
5,388,427 A 2/1995 Lee
5,782,106 A 7/1998 Park
6,092,382 A 7/2000 Gr.o slashed.nne

FOREIGN PATENT DOCUMENTS

| | | |
|---|---|---|
| EP | 0 509 476 A2 | 10/1992 |
| EP | 0 798 521 A2 | 10/1997 |
| EP | 1 074 802 A2 | 2/2001 |
| EP | 1 245 918 A2 | 10/2002 |
| GB | 1 434 356 | 5/1976 |

OTHER PUBLICATIONS

International Search Report on PCT/EP 03/11333 dated Jan. 29, 2004.

*Primary Examiner*—Chen Wen Jiang
(74) *Attorney, Agent, or Firm*—Gerard J. McGowan, Jr.

(57) ABSTRACT

A refrigeration apparatus with two compartments operating at two different temperatures wherein a freezer comprising a storing volume adapted to receive products to be stored at a temperature below 0° C., an evaporator within said storing volume and a compressor located outside said storing volume, is fitted with a storing box, adapted to receive products to be stored at a temperature above the temperature in the storing volume, located within the storing volume, said box being fitted with heating means.

7 Claims, 1 Drawing Sheet

REFRIGERATION APPARATUS

FIELD OF THE INVENTION

Figure 1:
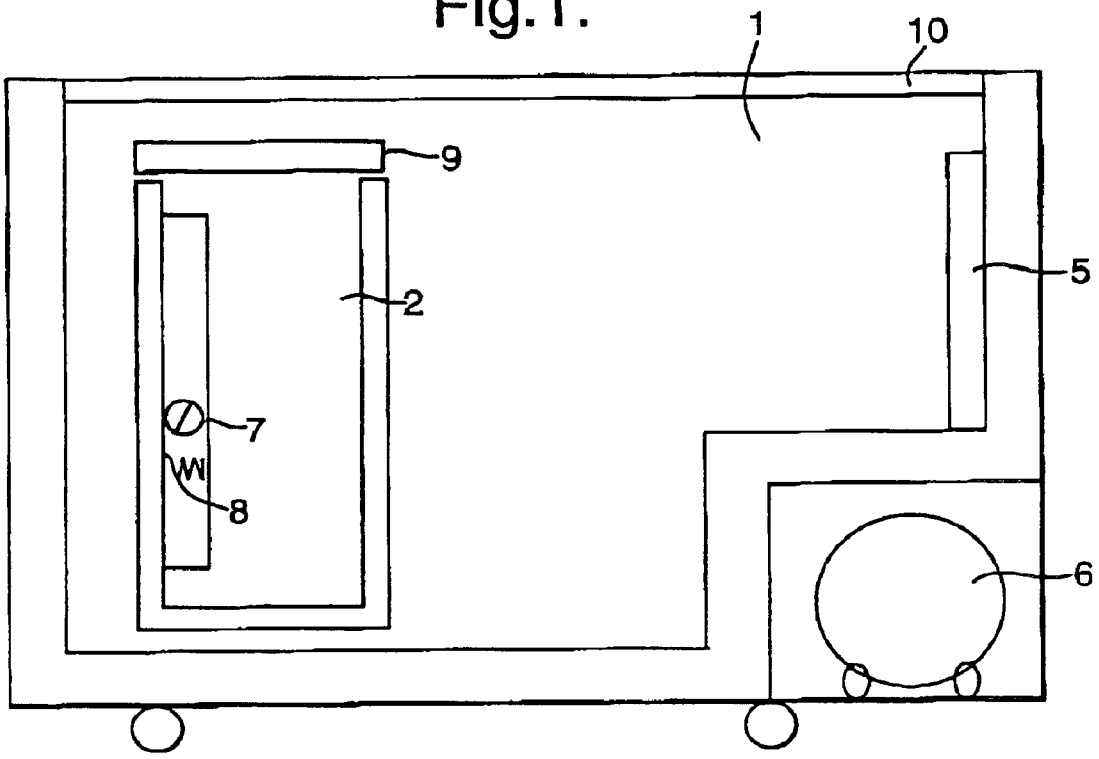

The present invention refers to a refrigeration apparatus of the type comprising at least a first compartment and at least a second compartment that are cooled down at different temperatures, as well as a temperature balancing device adapted to ensure a correct operation of the apparatus.

BACKGROUND OF THE INVENTION

Refrigerating apparatuses, used as display cabinets, in stores and shops, are well known wherein a single compartment is maintained at a certain temperature by a refrigerating circuit comprising a single compressor and at least one evaporator. These apparatuses are equipped with a door which can be either vertical, in the case of a 'cupboard like' cabinets, or horizontal, in the case of a 'flat-top', cabinet such as described in U.S. Pat. No. 3,729,243. In any case the door is transparent to allow for potential customers to see what is inside the display cabinet.

More and more products are now displayed in such cabinets while they may have different storage temperature.

There is therefore a need for refrigerating apparatus of the display cabinet type which can be used for simultaneously storing products at different temperatures.

Refrigeration apparatuses are well-known in the art which comprise a refrigerating circuit provided with a single compressor and two evaporators arranged in series and associated to a refrigerated compartment and a freezer compartment, respectively. Automatic control means enable the refrigerated compartment temperature to be set and the compressor to be caused to operate cyclically in order to keep respective pre-determined temperature ranges in the two compartments.

A temperature balancing device can be adapted in the cold storage compartment to artificially heat up the cold storage compartment when the ambient temperature is excessively low, in such a manner as to increase the rate of the operation cycles of the compressor, thereby preventing the temperature in the freezer compartment from increasing.

Such devices require the use of two evaporators, one in each compartment.

There is thus a need for refrigerating apparatuses of the display cabinet type presenting two compartments at two different temperatures, while requiring only evaporator means in one compartment.

It therefore is a purpose of the present invention to minimise the drawbacks of such prior-art solutions.

SUMMARY DESCRIPTION OF THE INVENTION

It is a first object of the invention to provide a refrigeration apparatus, situated in an environment at temperature Te, comprising;

- a first compartment at a temperature T1, the first compartment being accessible through at least an opening, and
- a second compartment at a temperature T2, T1 being colder than T2, T1 and T2 being colder than Te, the second compartment being located inside the first compartment,
- a refrigeration circuit in the first compartment adapted to keep temperature T1 within a range R1 through a sequence of energisation and de-energisation phases triggered by comparing actual temperature T1 with a first reference temperature T1r,
- heating means in the second compartment adapted to keep temperature T2 within a range R2.

This apparatus allows for storing at two different temperatures, both lower than the temperature Te of the room in which the apparatus is located.

The opening in the first compartment can either be on the top of the first compartment or on a side face of it. If it is on the top, it does not need a door or a lid (open top freezer), if it is on a side, it is preferable to have the opening closed by a door. The second compartment can be accessed either though an opening, or through a door.

Preferably, the refrigeration circuit comprises an evaporator, the evaporator being connected to a compressor located outside the first compartment. More preferably the second compartment does not contain an evaporator.

Preferably also, the second compartment door is transparent.

In a preferred embodiment of the invention, the heating means are triggered by comparing the actual temperature 12 with a second reference temperature T2r, thus keeping temperature T2 within a range R2.

In a particularly preferred embodiment of the invention, the reference temperatures T1r and T2r are set by means of control means. T1r is comprised between −16 to −23° C. and wherein T2r is comprised between −15° C. and +5° C., preferably below 0° C. even more preferably below −5° C.

It is a second object of the present invention to provide a process for manufacturing a refrigeration apparatus according to the invention wherein a freezer;

- comprising a storing volume adapted to receive products to be stored at a temperature below 0 C. (preferably between −16° C. and −23° C.), an evaporator within said storing volume and a compressor located outside said storing volume,
- is fitted with a storing box, adapted to receive products to be stored at a temperature above the temperature in the storing volume (preferably between −15° C. and +5° C., more preferably below 0° C., even more preferably below −5° C.), located within the storing volume, said box being fitted with heating means.

The evaporator in the first compartment can be isolated form the rest of the compartment by a wall. In this case means are provided for forcing air located in the first compartment to pass in the volume limited by the wall wherein the evaporator is located, thus cooling this air.

It is therefore possible, starting from a standard freezer such as those used as display cabinets to create two compartments which can be maintained at two different temperatures, thus allowing storing products at two different temperatures without having to dispose of the original freezer.

DETAILED DESCRIPTION OF THE INVENTION

The present invention will be further described by reference to the drawings wherein the sole FIGURE represents a schematic view of a refrigeration apparatus according to the invention.

As disclosed in FIG. 1, the refrigeration apparatus according to the present invention is of the type comprising a freezer compartment 1 and a cold storage compartment 2. In a known manner, the two compartments 1 and 2 are thermally insulated. Preferably, their walls comprise insulating material having a thermal conductivity in the range of 0.5 to 50 milliwatt (meter Kelvin)$^{-1}$. The insulating material can be, for example, polystyrene, fibreglass, or vacuum.

The freezer compartment 1 is fitted with an evaporator 5 connected to a compressor 6. Through a sequence of switch on and switch off periods, the freezer compartment 1 is kept at a temperature T1. The switch ons and switch offs are triggered by comparing the actual temperature T1 in the freezer compartment with a reference temperature T1r which can be set by means of control means not represented.

The freezer compartment is accessed through an opening 10 which can either be closed by a door or a lid, or left open (open top freezer).

The cold storage compartment 2 is fitted with heating means 7, a fan 8 and a door or a lid 9. The cold storage compartment is maintained at a temperature T2, higher than T1, by the heating means 7 which are triggered by comparing the actual temperature T2 with a reference temperature T2r which can be set by means of control means not represented.

As can be seen in FIG. 1, an existing freezer, for example of the open top type, can be fitted with a box, said box being itself fitted with heating means 7, a fan 8 and a door or lid 9. Thus an existing freezer can easily be fitted with additional means which allow for the creation of two compartments operating at two different temperatures without the need for an additional refrigeration circuit.

In operation, temperature T1 in the first compartment is maintained at a set temperature by the evaporator 5 and the compressor 6. Through heat exchange with the second compartment, temperature T2 in the second compartment is brought down. When this temperature reaches a reference temperature, heating means 7 and fan 8 are activated.

What is claimed is:

1. Refrigeration apparatus, situated in an environment at temperature Te, comprising:

a first compartment at a temperature T1, the first compartment being accessible through at least an opening, and a second compartment at a temperature T2, T1 being colder than T2, T1 and T2 being colder than Te, the second compartment being located inside the first compartment, a refrigeration circuit in the first compartment adapted to keep temperature T1 within a range R1 through a sequence of energisation and de-energisation phases triggered by comparing temperature T1 with a first reference temperature T1r, heating means in the second compartment adapted to keep temperature T2 within a range R2.

2. Refrigeration apparatus according to claim 1, wherein the refrigeration circuit comprises an evaporator, the evaporator being connected to a compressor located outside the first compartment.

3. Refrigeration apparatus according to claim 2 wherein the second compartment does not contain an evaporator.

4. Refrigeration apparatus according to claim 1, wherein the heating means are triggered by comparing the actual temperature T2 with a second reference temperature T2r.

5. Refrigeration apparatus according to claim 4 wherein the reference temperatures T1r and T2r are set by means of control means.

6. Refrigeration apparatus according to claim 5 wherein T1r is comprised between −16 and −23° C. and wherein T2r is comprised between −15° C. and +5° C.

7. Process for providing a refrigeration apparatus according to claim 1 wherein a freezer;

comprising a storing volume adapted to receive products to be stored at a temperature below 0° C., an evaporator within said storing volume and a compressor located outside said storing volume, is fitted with a storing box, adapted to receive products to be stored at a temperature above the temperature in the storing volume, located within the storing volume, said box being fitted with heating means.

* * * * *